US007237815B2

(12) United States Patent
Ashby, Sr.

(10) Patent No.: US 7,237,815 B2
(45) Date of Patent: Jul. 3, 2007

(54) LIFTING APPARATUS

(75) Inventor: Rusty Stewart Ashby, Sr., N. Charleston, SC (US)

(73) Assignee: Nucor Corporation, Charlotte, NC (US)

( * ) Notice: Subject to any disclaimer, the term of this patent is extended or adjusted under 35 U.S.C. 154(b) by 112 days.

(21) Appl. No.: 10/708,609

(22) Filed: Mar. 15, 2004

(65) Prior Publication Data

US 2005/0200147 A1 Sep. 15, 2005

(51) Int. Cl.
*B66C 1/42* (2006.01)

(52) U.S. Cl. ..... 294/110.1; 294/90

(58) Field of Classification Search ..... 294/110.1, 294/90, 67.31, 2, 86.12, 86.13, 116, 86.14, 294/113

See application file for complete search history.

(56) References Cited

U.S. PATENT DOCUMENTS

| | | | | | |
|---|---|---|---|---|---|
| 1,008,724 | A | * | 11/1911 | Lenderman | 294/110.1 |
| 1,338,023 | A | | 4/1920 | Leduc | |
| 1,730,705 | A | | 10/1929 | Wild | |
| 2,226,652 | A | | 12/1940 | York | |
| 2,437,485 | A | | 3/1948 | Sonnenschein | |
| 2,526,085 | A | | 10/1950 | Rotollo | |
| 2,576,193 | A | * | 11/1951 | Reynolds | 294/106 |
| 2,911,251 | A | * | 11/1959 | Osborn | 294/110.1 |
| 2,951,725 | A | | 9/1960 | St. Jean | |
| 3,020,078 | A | | 2/1962 | Ray | |
| 3,057,654 | A | | 10/1962 | Beauchamp, Jr. | |
| 3,193,320 | A | | 7/1965 | Gardner et al. | |
| 3,273,931 | A | | 9/1966 | Caldwell et al. | |
| 3,330,591 | A | | 7/1967 | Pavelka | |
| 3,451,711 | A | * | 6/1969 | Carpenter | 294/113 |
| 3,600,031 | A | * | 8/1971 | Coleman et al. | 294/88 |
| 3,790,204 | A | * | 2/1974 | Lighthipe et al. | 294/110.1 |
| 3,915,488 | A | * | 10/1975 | Anderson | 294/90 |
| 4,030,698 | A | | 6/1977 | Hansen | |
| 4,303,269 | A | | 12/1981 | Faughnan | |
| 4,511,169 | A | * | 4/1985 | Willis | 294/116 |
| 5,171,053 | A | | 12/1992 | Rouleau | |
| 5,303,968 | A | | 4/1994 | Trine | |

* cited by examiner

*Primary Examiner*—Gene C. Crawford
*Assistant Examiner*—Esther Onyinyechi Okezie
(74) *Attorney, Agent, or Firm*—Moore & Van Allen PLLC; Matthew W. Witsil

(57) ABSTRACT

An apparatus for lifting articles. The lifting apparatus may lack mechanization, may be used in conjunction with hoist means, and may operate on, among other things, the principles of leverage, gravity, and friction. The apparatus may include a frame disposable on an article to be lifted and at least two fulcrums distributed generally symmetrically about the frame. At least two lifting arms may be pivotally mounted to a corresponding fulcrum. A central exertion member includes a top surface having one sloped portion for each lifting arm. Upon application of upward force to the exertion member, the exertion member applies force to the upper ends of the lifting arms. The lifting arms then rotate around the corresponding fulcrum to contact the article for lifting.

33 Claims, 8 Drawing Sheets

LIFTING APPARATUS

BACKGROUND OF INVENTION

The present invention relates to lifting apparatus, and more particularly, in conjunction with hoist means, devices for grasping, raising, moving, and releasing articles.

Various industries require lifting of relatively heavy articles such as steel cylinders, barrels, drums, paper rolls, boxes, crates, and articles of other shapes. By way of example, in the steel manufacturing industry, cylindrical spacers are used to build rolls for straightening steel. The spacers are made of steel and are stacked coaxially for storage on the mill floor, and may be on the order of, for example, 24 inches (61 cm) outer diameter and from 2 inches (5 cm) to 8 inches (20 cm) tall. In general, such spacers have been moved from place to place within a steel mill by use of a conventional grapple suspended from hoist means, such as a crane or a forklift. Other objects including coils, bars, and similar articles may be moved similarly.

In moving stacked cylindrical spacers, a forklift operator must get off the forklift, a crane operator must leave the crane, or another worker must be used, in order to mount the grapple on the top spacer on the stack. The grapple's individual hooks must be lodged between the spacers. Common means of providing room between spacers is to use hammers, chisels, and screwdrivers to pry the top spacer upward. Safety is compromised because of the chance of injuries such as back strain or crushed fingers while mounting the grapple on the spacer. Further, assembly of the straightener rolls is excessively time consuming, using both the capability of the workers and the equipment that could be used to perform other tasks.

Additional types of conventional grapples exist in addition to those that rely on hooks to support an object from the bottom. Where an object to be lifted provides a protrusion such as a flange at its upper edge, some conventional grapples have operated on the principle of grasping the protrusion or the object immediately under the protrusion. Others clamp onto the object directly, but may be inadequate in the amount of force applied, complex to fabricate, difficult to use, or any combination thereof. Further, some conventional grapples include means for automatically or semi-automatically latching the grapple hooks or grips in position, including either being retracted or engaged onto an article to be lifted. This latching means is often complicated, either in manufacture, use, or both, and may also be unreliable.

Accordingly, there exists a need for a lifter that is relatively safe for use by workers and can be quicker to use than a conventional grapple. The lifter should be reliable and simple to use.

SUMMARY OF INVENTION

In accordance with one embodiment of the present invention, a lifting apparatus may lack mechanization, may be used in conjunction with hoist means, and may operate on, among other things, the principles of leverage, gravity, and friction. Such an embodiment may include a frame disposable on an article to be lifted and at least two fulcrums distributed generally symmetrically about the frame. At least two lifting arms may be pivotally mounted to a corresponding fulcrum, with each lifting arm having a lower end extending lower than the fulcrum and an upper end extending above the fulcrum. A central exertion member includes a top surface having one sloped portion for each lifting arm, with the top surface of each sloped portion being downwardly inclined from the center of the exertion member and below the upper ends of the respective lifting arms. Upon application of upward force to the exertion member, the exertion member applies force to the upper ends of the lifting arms. The lower end of each lifting arm is adapted to not contact the article in a retracted position and to contact the article in an engaged position. The application of force by the exertion member to the lifting arms causes the lifting arms to rotate around the corresponding fulcrum from the retracted position to the engaged position.

In another embodiment according to the present invention, a lifting apparatus includes a frame disposable on a cylinder to be lifted, a lifting assembly, and first and second load bearing means. The frame has a generally central and substantially vertical axis, and includes a substantially planar and horizontally oriented base, vertical uprights, at least two fulcrums, and a ring. The base has an outside edge proximate to the cylinder's outside edge. The vertical uprights have a lower end mounted to and distributed in spaced relation about the base. The fulcrums are distributed generally symmetrically around the frame and extend outward with respect to the central axis. The ring is in a horizontal plane and is mounted to the upper end of the uprights, connecting adjacent uprights. First load bearing means are mounted to the frame and are adapted to receive lifting means.

The lifting assembly includes lifting arms, grippers, a central exertion member, and vertical posts. The lifting arms are distributed around the frame with each having an approximately vertical portion outside of the frame and pivotally mounted to a corresponding fulcrum. The lower end of the lifting arms extends lower than the base, and an approximately horizontal portion extends radially from a central end proximate to the axis and above the ring. The horizontal portions are mounted to the upper end of the respective vertical portions, and each includes a vertical slot. The grippers are mounted to the vertical portion of the lifting arms below the base, and have a gripping surface proximate to the cylinder. In a retracted position the gripping surface does not contact the cylinder and in an engaged position the gripping surface contacts with the cylinder. The central exertion member has a top surface with one sloped portion for each lifting arm. The top surface of each sloped portion is downwardly inclined from the central axis and proximate to the bottom of each lifting arm horizontal portion, proximate to the central axis. The vertical posts, for lifting the lifting assembly, are mounted to the top of the exertion member. One vertical post is mounted to each sloped portion of the exertion member and extends through and is slidably disposed in a corresponding slot in the horizontal portion of each lifting arm. Second load bearing means mounted to the vertical posts and adapted to receive lifting means.

When upward force is applied to the first load bearing means, the grippers are in a retracted position. When upward force is applied to the second load bearing means, the sloped top surfaces of the exertion member apply force to the lifting arms to cause the horizontal portion central end of each lifting arm to move upward and radially outward. The upper end of each vertical portion moves outward, rotating each vertical portion around the fulcrum and actuating the grippers to be in the engaged position.

In accordance with another embodiment of the present invention, a method of making a lifting apparatus includes assembling a frame disposable on an article to be lifted. At least two fulcrums are distributed generally symmetrically around the frame. A lifting arm is pivotally mounted to each fulcrum, with each lifting arm having a lower end extending lower than the fulcrum and an upper end extending above the fulcrum. The lower end of each lifting arm is adapted to not contact the article in a retracted position and to contact the article in an engaged position. A central exertion member is provided that includes a top surface having one sloped portion for each lifting arm. The top surface of each sloped portion is downwardly inclined from the center of the exertion member and is below the upper ends of the respective lifting arms to apply force to the upper ends of the lifting arms upon application of upward force to the exertion member. The upward force on the lifting arms causes the lifting arms to rotate around the corresponding fulcrum from the retracted position to the engaged position.

In accordance with another embodiment of the present invention, a method of lifting an article includes providing a lifting apparatus disposable on an article to be lifted. The lifting apparatus includes a frame including at least two fulcrums distributed generally symmetrically around the frame. First load bearing means are mounted to the frame. At least two lifting arms are each pivotally mounted to a corresponding fulcrum. Each lifting arm has a lower end extending lower than the fulcrum and an upper end extending above the fulcrum. The lower end of each lifting arm is adapted to not contact the article in a retracted position and to contact the article in an engaged position. A central exertion member includes a top surface including one sloped portion for each lifting arm. The top surface of each sloped portion is downwardly inclined from the center of the exertion member and is below the upper ends of the respective lifting arms to apply force to the upper ends of the lifting arms upon application of upward force to the exertion member. Second load bearing means are mounted to the exertion member. Upward force is applied to the first load bearing means to lift the lifting apparatus, which is placed into position on the article. The first load bearing means is released. Upward force is applied to the second load bearing means to cause the exertion member to apply force to the upper ends of the lifting arms causing each lifting arm to rotate around the corresponding fulcrum from the retracted position to the engaged position. Increased upward force is applied to the second load bearing means to lift the lifting apparatus and the article.

Features and advantages of the present invention will become more apparent in light of the following detailed description of some embodiments thereof, as illustrated in the accompanying figures. As will be realized, the invention is capable of modifications in various respects, all without departing from the invention. Accordingly, the drawings and the description are to be regarded as illustrative in nature, and not as restrictive.

DETAILED DESCRIPTION

Figure 1:
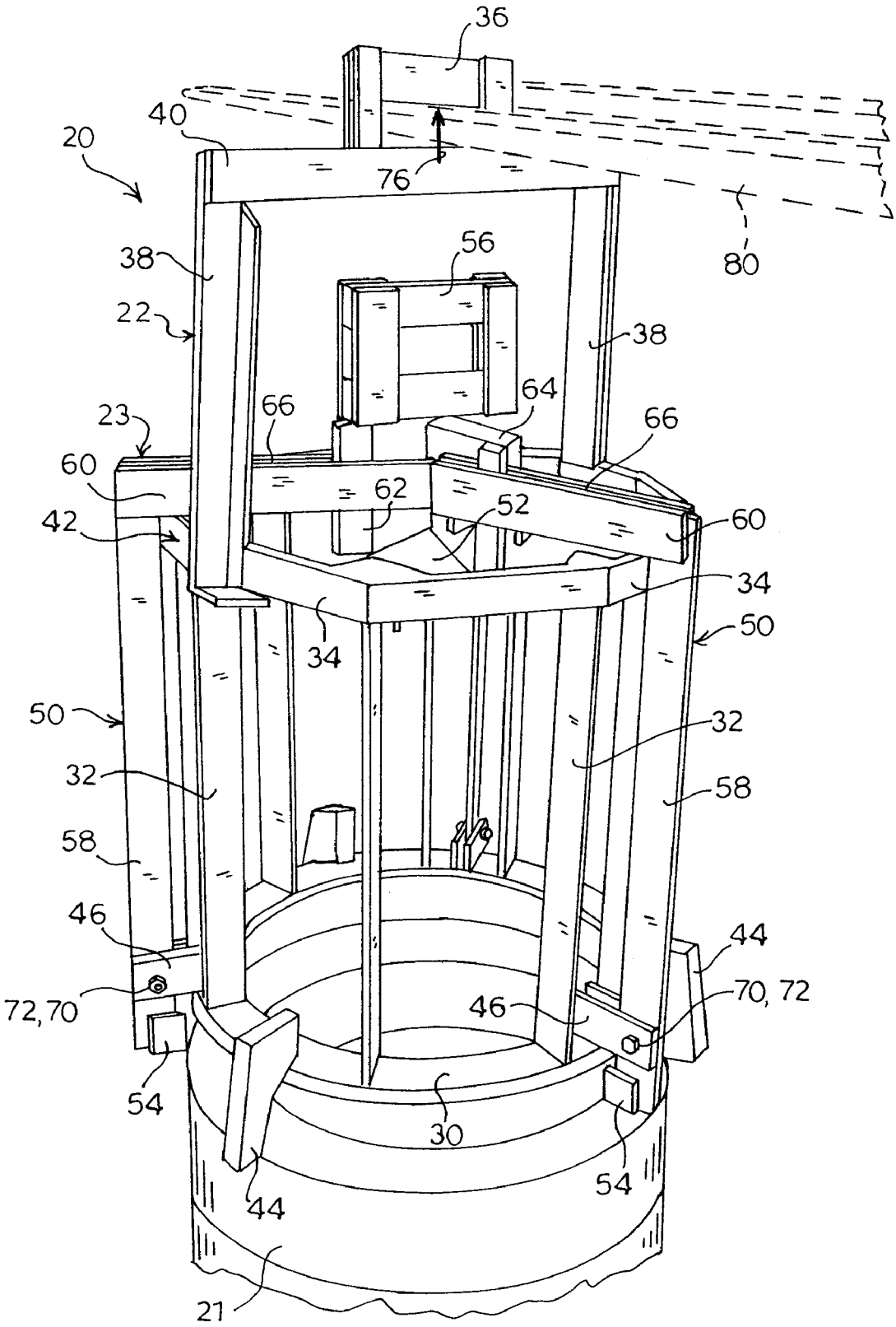
FIG. 1 is a front perspective view of a lifter according to an embodiment of the present invention.

The invention is an apparatus that may be used for lifting articles. In particular, the invention may be used for lifting heavy cylindrical spacers used to build rolls for straightening steel, but may be used for lifting any heavy cylindrical objects and other shapes as well. Reference herein is made specifically to cylindrical spacers, but it should be understood that the invention in its various embodiments may change in its shape and may be applied to other shapes of articles. As an example embodiment applied to a cylinder, when the device is placed on the end of an upright cylinder, the device has lifting arms with grippers that are spaced from the cylinder. The lifting arms are actuated by an upward force and rotate around a fulcrum, and the grippers are forced into contact with the cylinder. As upward force is further applied to increase the lateral force exerted by the grippers, the cylinder is lifted. One means for applying upward force, for example, is a forklift, and another is a crane.

The scope of the invention is not intended to be limited by materials or dimensions listed herein, but may be carried out using any materials and dimensions that allow the construction and operation of the present invention. Materials and dimensions depend on the particular application.

In the Figures herein, unique features receive unique reference numerals, while features that are the same in more than one drawing receive the same reference numerals throughout. For clarity of illustration reference numerals for some features may be omitted where there are like or similar features that are labeled with reference numerals. Further, certain terms of orientation are used, such as "upper," "lower," "top," "bottom," "left," "right," "horizontal," and "vertical." These terms are generally for convenience of reference, and should be so understood unless a particular embodiment requires otherwise.

Referring now to the drawings, FIG. 1 shows an embodiment of a lifting apparatus or lifter 20 according to the present invention. In this embodiment the lifter 20 is applied to lift a cylinder 21, which may specifically be, for example, a cylindrical steel spacer for building rolls for straightening steel. The lifter 20 comprises a frame 22 and a lifting assembly 23. Perspective views of the frame 22 and lifting assembly 23 are also shown individually in FIGS. 4 and 5 respectively. The frame 22 has a substantially planar and horizontally oriented base 30 that may be, for example, annular in shape. Uprights 32 are welded to the base 30, and horizontal members 34 are welded to the top of the uprights 32. The horizontal members 34 may form a ring 42; the ring 42 may be any shape as appropriate for the application, and may be round in addition to being formed by connected linear horizontal members 34.

An upper lifting eye 36 is operatively connected to the horizontal members 34. The lower ends of the vertical members 38 are attached to the horizontal members 34. The upper ends of the vertical members 38 are connected to a horizontal element 40, which is attached to the upper lifting eye 36. Alternatively a chain, cable, or the like may be used in place of the upper lifting eye 36 and associated parts 38, 40. Centering guide members 44 cause the lifter 20 to be centered on the cylinder 21. Fulcrums 46 extend outward horizontally from and may be attached to the base 30 or other suitable location, such as to the uprights 32. The fulcrums 46 are distributed generally symmetrically around the frame 22. The frame 22 of this embodiment of a lifter 20 has no moving parts. Unless otherwise indicated herein, when a reference is made to connecting, mounting, attaching, or welding, a fixed relationship should be understood to be made between the applicable parts, including but not limited to welding, using more than one bolt, or the like.

The lifting assembly 23 may include lifting arms 50, an exertion member 52, grippers 54, and a lower lifting eye 56. The lifting arms 50 include an approximately vertical portion 58 welded to an approximately horizontal portion 60, and are radially positioned around the frame 22 in three locations. At the center of the circle defined by the frame 22 the exertion member 52 is welded to vertical posts 62. In this embodiment the vertical posts 62 extend upward to connect to horizontal parts 64 that are mounted to the lower lifting eye 56. Alternatively, a chain, cable, or the like may be used in place of the lower lifting eye 56. The vertical posts 62 may pass through slots 66 in the horizontal portion 60 of the lifting arms 50. The lifter 20 may be fabricated from steel, although other metals and materials may be used depending on the application and as known by one of ordinary skill in the art.

At each location where the vertical portion 58 of the lifting arms 50 is proximate to the circular base 30, a pivotal connection is made to a fulcrum 46. The lifting arms 50 have a lower end extending below the fulcrum 46 and an upper end extending above the fulcrum 46. This pivotal connection 70 may be a bolted attachment or the like, and allows the lifting arm to rotate around a single bolt 72. The lifting arms 50 may have grippers 54 at or proximate to their lowest point.

Upward force 76 may be applied to the upper lifting eye 36 using hoist means, in this case shown to be a forklift 80. The upper lifting eye 36 may be used to carry the entire apparatus 20, and when the force 76 is applied to the upper lifting eye 36 the grippers 54 are in a retracted position. In the retracted position shown the grippers 54 do not contact the cylinder 22 and the lifter 20 may be placed in position on top of the cylinder 22. The grippers 54 are in the retracted position because the weight of the lifting assembly within the ring 42 is great enough that the exertion member 52 is in a low position when upward force is not being applied to it. In the retracted position the grippers 54 in different embodiments may contact the article to be lifted, but the force applied in the retracted position would not be great enough to lift the article.

Figure 2:
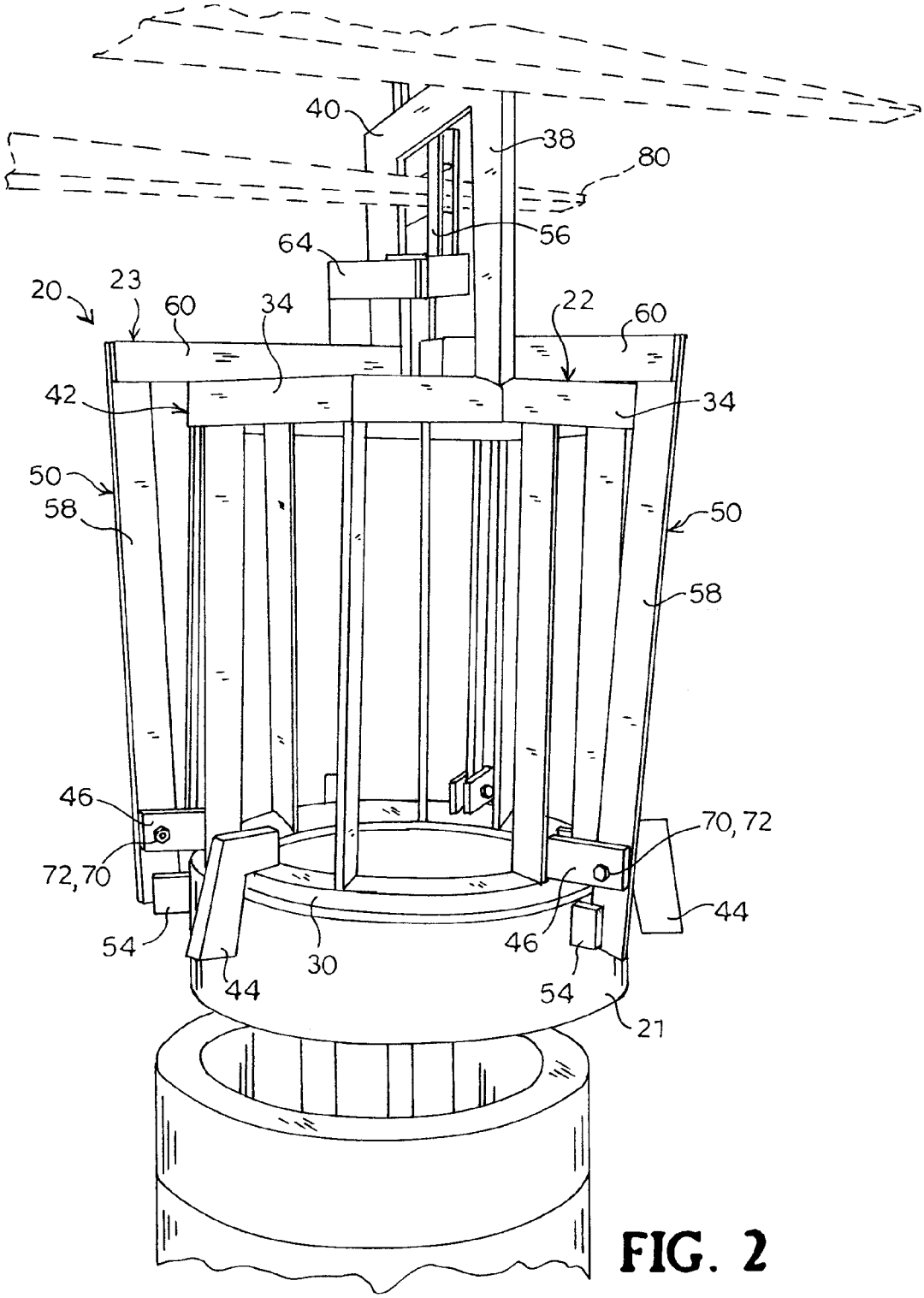
FIG. 2 is a side perspective view of the lifter of FIG. 1.
Figure 3:
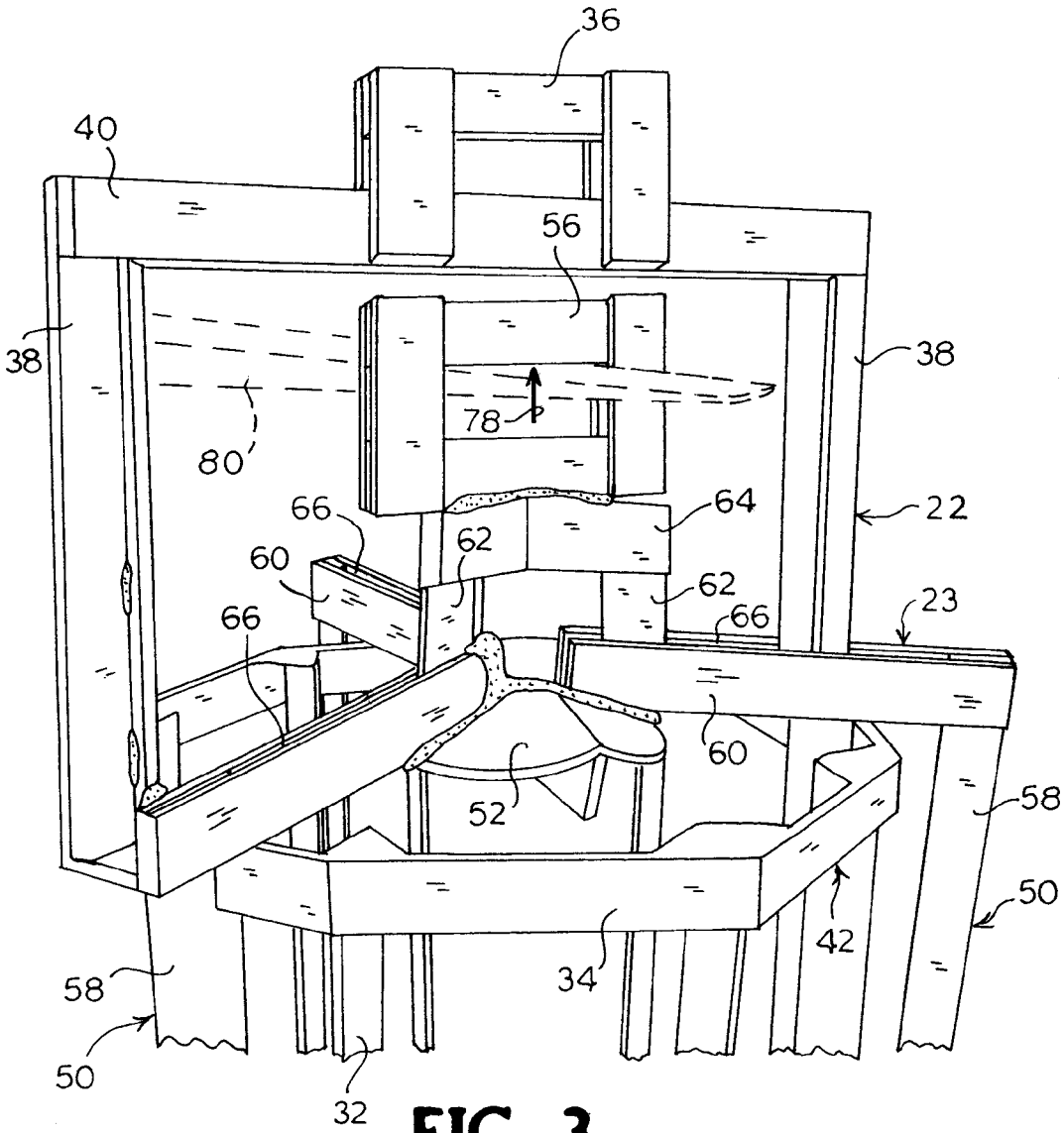
FIG. 3 is an enlarged front perspective view of the upper portion of the lifter of FIG. 1.

FIGS. 2 and 3 show the lifting arms 50 being actuated and the cylinder 22 being lifted. When an upward force 78 is applied and the lower lifting eye 56 is moved upward, the exertion member 52 moves upward to contact the central ends of the horizontal portion 60 of the lifting arms 50. The exertion member 52 is shaped so as to be sloped downward from the center of the lifter 20 at each location where contacting the lifting arms 50, and the lifting arms 50 are forced outward as permitted by the slots 66 in the horizontal portion 60 of the lifting arms 50. As shown, the contact between the lifting arm 50 and the exertion member 52 is sliding engagement although other types of contact such are rolling engagement could be used, for example, with the addition of wheels to the upper ends of the lifting arm 50. When the upper part of each lifting arm 50 is forced outward, the lower part, with the respective gripper 54, is forced inward until the grippers 54 contact the cylinder 21 and thereby are in an engaged position. In one embodiment the grippers 54 are made of flat stock steel which is a mild steel, with dimensions of ¼-inch by 2¼ inch by 2-inch (0.6 cm by 5.7 cm by 5.1 cm) and with horizontal teeth cut ¼-inch (0.6 cm) deep and spaced at ¼-inch (0.6 cm) intervals. The dimensions, material, and teeth may vary depending on the application. For example, stainless steel may be used and would be more durable than flat stock.

The cylinder 21 is subjected to opposing forces exerted by the grippers 54 towards the substantially vertical central axis of the cylinder. As the force increases the cylinder 22 is lifted. The force on the cylinder 22 increases with the length of the vertical portions 58 above the fulcrums 46, because this increases the moment arm and leverage around each fulcrum 46.

Figure 4:
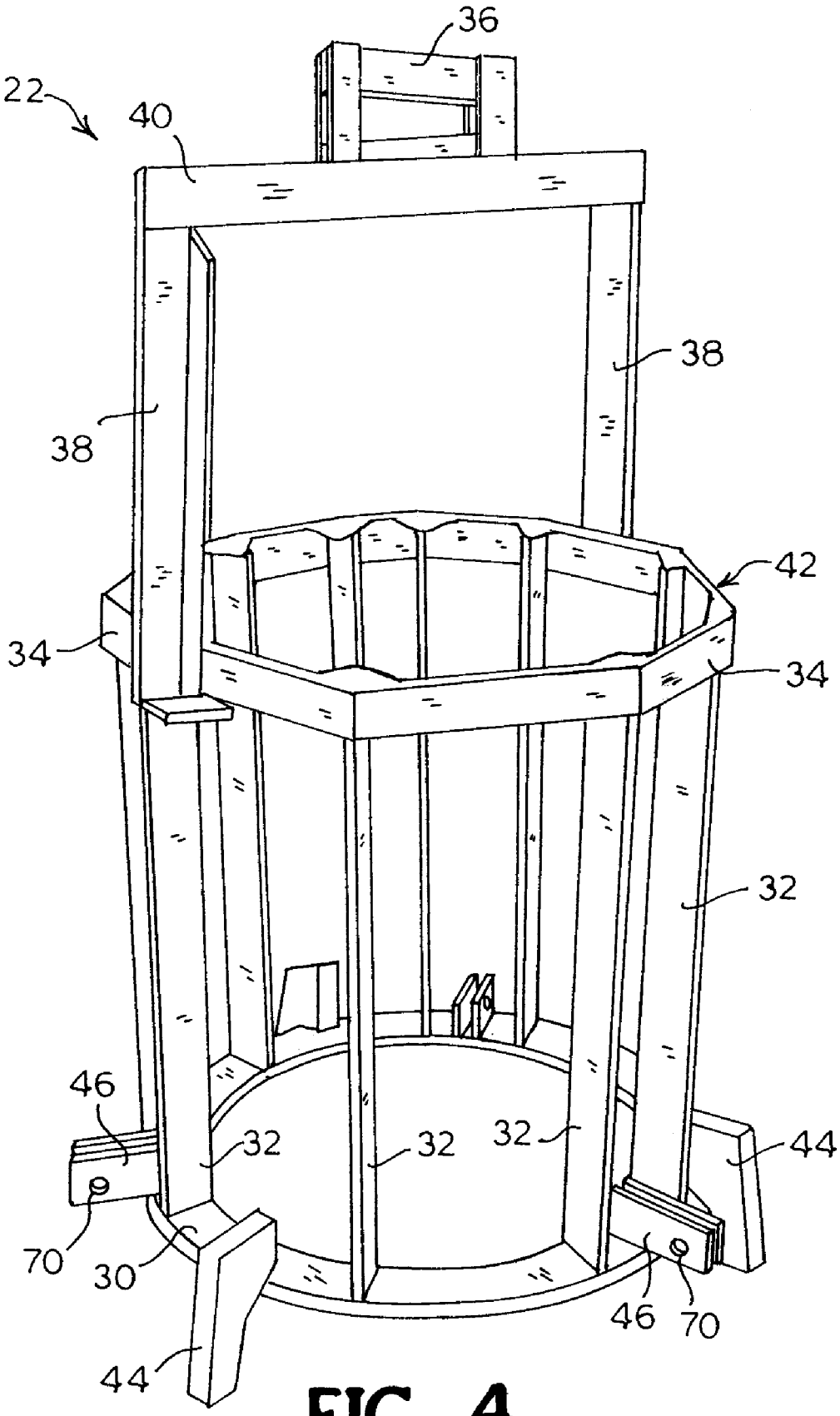
FIG. 4 is front perspective view of a frame of the lifter of FIG. 1.
Figure 5:
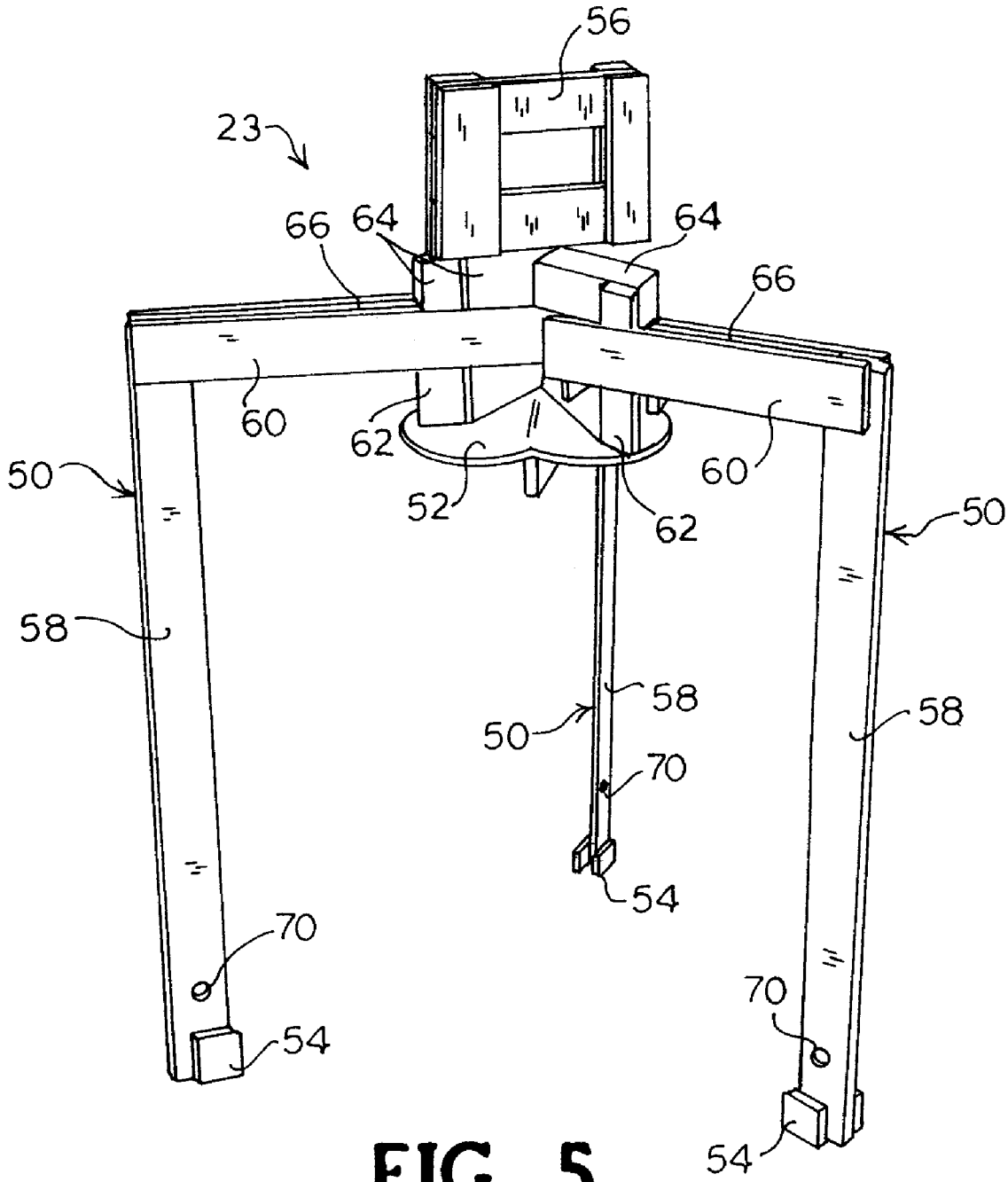
FIG. 5 is a front perspective view of a lifting assembly of the lifter of FIG. 1.

FIGS. 4 and 5 respectively show the frame 22 and the lifting assembly 23. In the embodiment of the lifter 20 that is shown, the only connection points between the frame 22 and the lifting assembly 23 are at the bolted connections 70 at the fulcrums 46 (FIG. 4). To assemble this embodiment of the lifter 20, some parts must be left detached so that the lifting assembly 23 may be inserted into the frame 22. For example, the vertical members 38 may be mounted to the horizontal members 34 after inserting the lifting assembly 23 into and around the frame 22.

Figure 6:
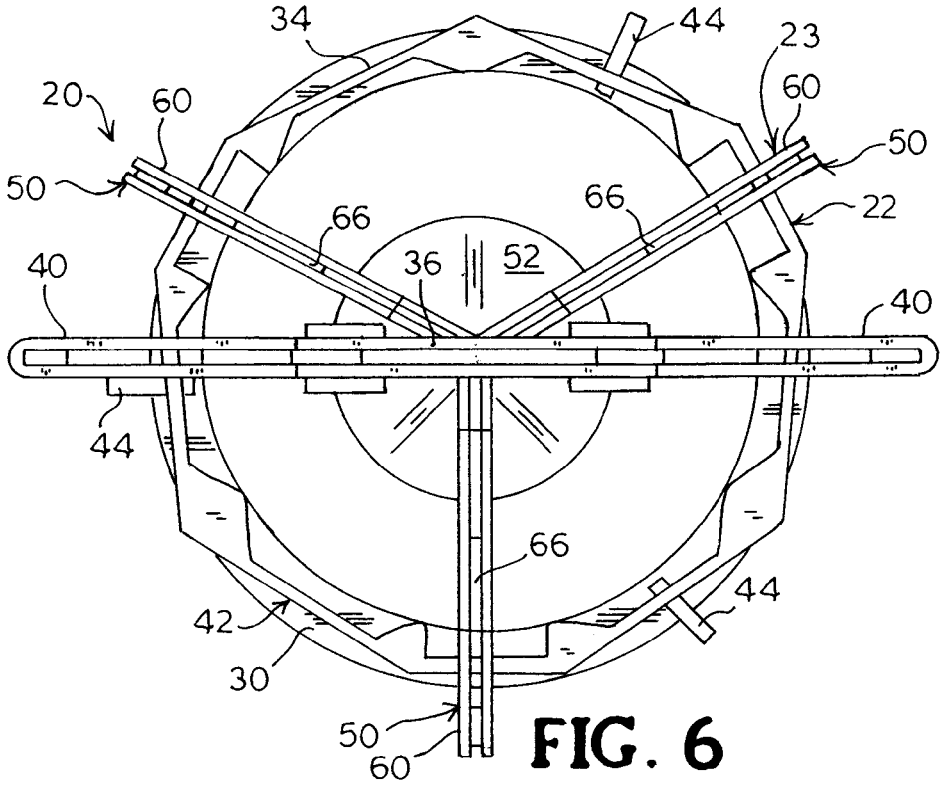
FIG. 6 is a top plan view of the lifter of FIG. 1.
Figure 7:
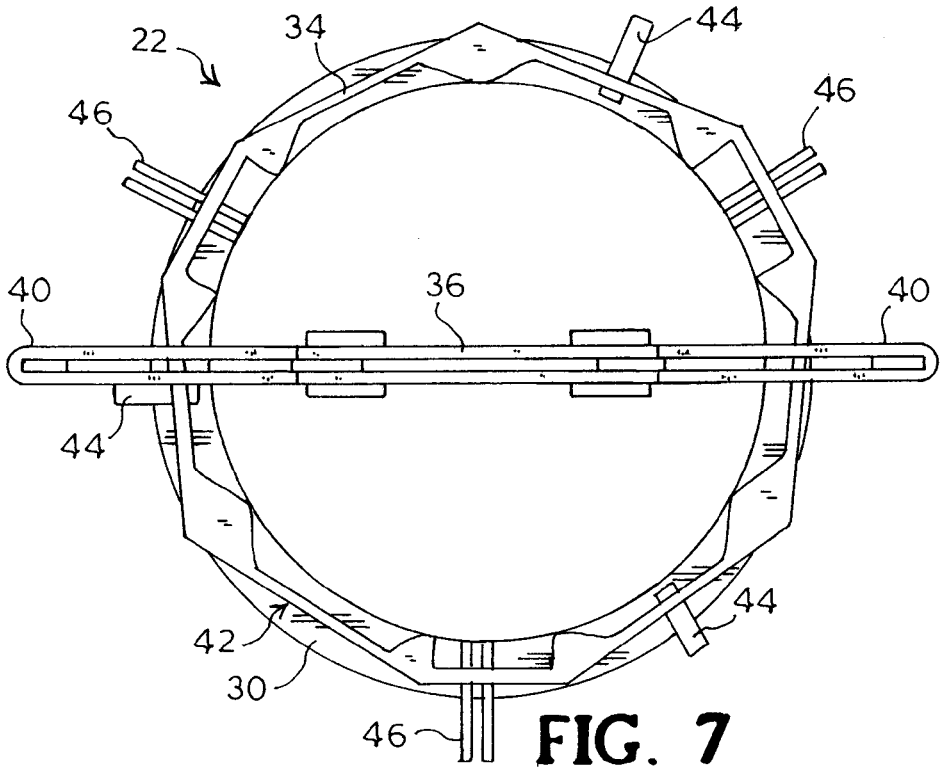
FIG. 7 is a top plan view of the frame of FIG. 4.
Figure 8:
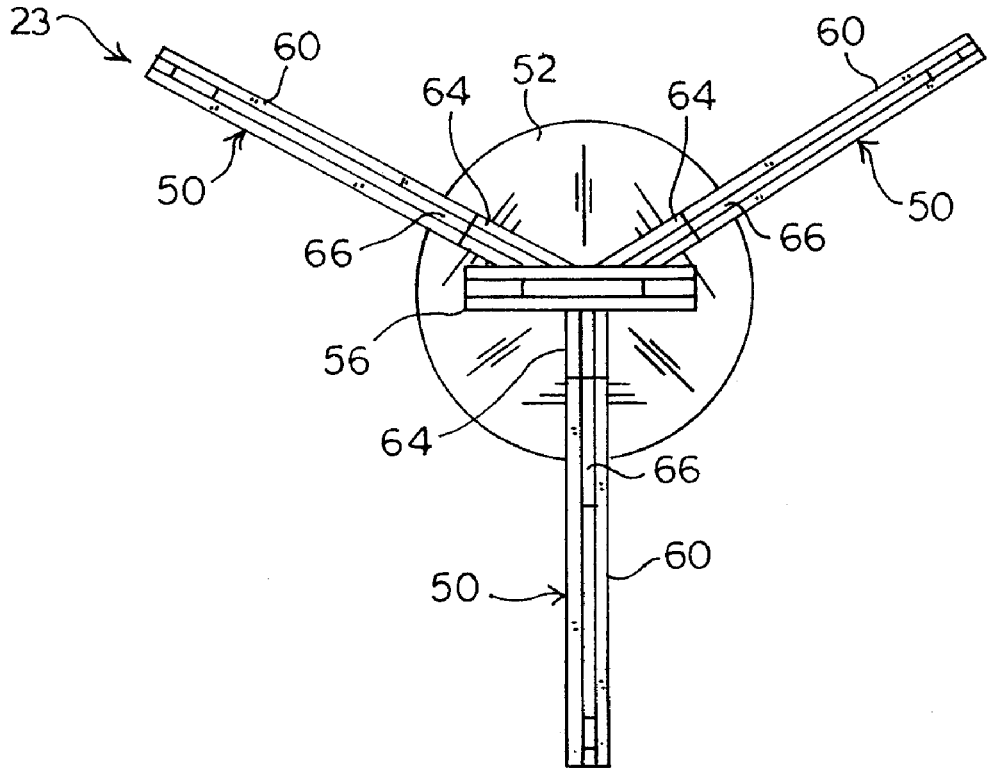
FIG. 8 is a top plan view of the lifting assembly of FIG. 5.
Figure 9:
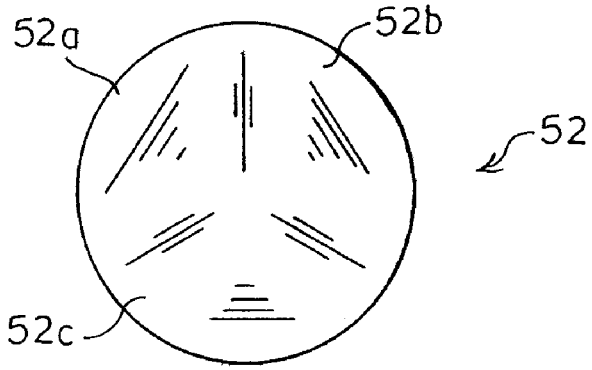
FIG. 9 is a top plan view of an exertion member of the lifting assembly of FIG. 5.

FIGS. 6, 7, and 8 are respectively top views of the lifter 20, the frame 22, and the lifting assembly 23. In FIGS. 6 and 8 three lifting arms 50 are shown in the lifting assembly 23. The exertion member 52 has a top surface with one sloped portion for each lifting arm 50. FIG. 9 shows the exertion member 52, having three sloped top surfaces 52*a*, 52*b*, 52*c* as necessary to force the three lifting arms 50 outward. The top surface of each sloped portion 52*a*, 52*b*, 52*c* is downwardly inclined from the center of the exertion member 52, and is below the upper ends of respective lifting arms 50. Different configurations are possible that are still within the scope of the present invention. For example, the lifter in another embodiment could have only two lifting arms that exert directly opposing forces, and the exertion member would have only two sloped surfaces. Any shape object that has a surface on which the base 30 may rest and having sides that grippers can contact may be lifted.

Figure 10:
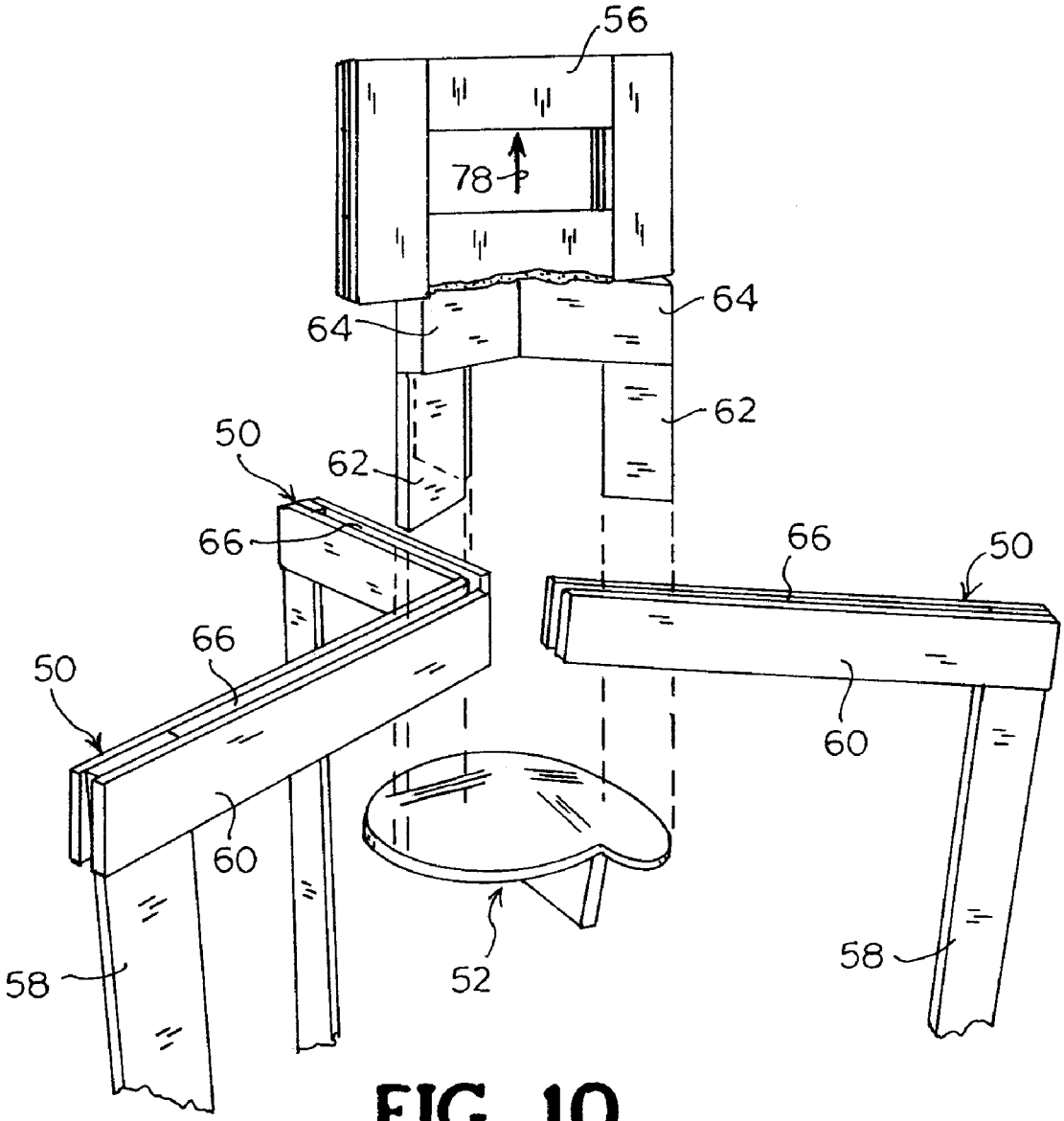
FIG. 10 is an exploded view of a central portion of the lifting assembly of FIG. 5.

An exploded view of the upper portion of the lifting assembly according to an embodiment of a lifter 20 is shown in FIG. 10. The bottom ends of the vertical posts 62 are mounted to the exertion member 52. The vertical posts 62 pass though the slots 66 in the horizontal portions 60 of the lifting arms 50, and are mounted to the horizontal parts 64 that are in turn mounted to the lower lifting eye 56. When upward force 78 is applied to the lower lifting eye 56 the horizontal portion 60 of the lifting arms 50 slides around the vertical posts 62, and as previously described the horizontal portions 60 are forced upward and outward, the upper ends of the vertical portions 58 are forced outward, and the grippers 54 are actuated to the engaged position.

Specific embodiments of an invention are described herein. One of ordinary skill in the structural engineering arts will recognize that the invention has other applications in other environments. In fact, many embodiments and implementations are possible. For example, as previously noted the lifter of the present invention may vary in shape and dimension and may be applied to other types and shapes of articles than cylindrical spacers. In addition, the recitation "means for" is intended to evoke a means-plus-function reading of an element in a claim, whereas, any elements that do not specifically use the recitation "means for," are not intended to be read as means-plus-function elements, even if they otherwise include the word "means." The following claims are in no way intended to limit the scope of the invention to the specific embodiments described.

What is claimed is:

1. A lifting apparatus comprising:

a frame disposable on an article to be lifted and including at least two fulcrums distributed generally symmetrically around the frame;

first load bearing means mounted to the frame and adapted to receive lifting means;

at least two lifting arms each pivotally mounted to a corresponding fulcrum, each lifting arm having a lower end extending lower than the fulcrum and an upper end extending above the fulcrum;

a central exertion member including a top surface having one sloped portion for each lifting arm, the top surface of each sloped portion being downwardly inclined from the center of the exertion member and below the upper ends of the respective lifting arms to apply force to the upper ends of the lifting arms upon application of upward force to the exertion member; and second load bearing means mounted to the exertion member and adapted to receive lifting means;

wherein the lower end of each lifting arm is adapted not to contact the article in a retracted position and to contact the article in an engaged position, wherein upon application of upward force to the first load bearing means the lifting apparatus may be lifted, in the absence of other mechanical means mounted to the lifting apparatus, with the lifting arms in the retracted position, wherein in the absence of the application of external force to the second load bearing means the lifting arms are in the retracted position, and wherein upon application of upward force to the second load bearing means the lifting arms rotate around the corresponding fulcrum from the retracted position to the engaged position.

2. The lifting apparatus of claim 1, wherein the exertion member engages the upper ends of the lifting arms in a manner selected from the group consisting of sliding engagement and rolling engagement.

3. The lifting apparatus of claim 1, wherein the at least two lifting arms each comprise an approximately vertical portion outside of the frame mounted to an approximately horizontal portion extending outward from the exertion member to the upper end of the respective vertical portions, the lifting arms have various positions, and the approximately vertical portion remains approximately vertical and the approximately horizontal portion remains approximately horizontal throughout the various positions.

4. A lifting apparatus comprising:

a frame disposable on an article to be lifted and including at least two fulcrums distributed generally symmetrically around the frame;

at least two lifting arms each pivotally mounted to a corresponding fulcrum, each lifting arm having a lower end extending lower than the fulcrum and an upper end extending above the fulcrum;

a central exertion member including a top surface having one sloped portion for each lifting arm, the top surface of each sloped portion being downwardly inclined from the center of the exertion member and below the upper ends of the respective lifting arms to apply force to the upper ends of the lifting arms upon application of upward force to the exertion member; and load bearing means mounted to the frame and adapted to receive lifting means, wherein the load bearing means includes:

at least two vertical members mounted to the frame at their lower ends and on opposite sides of the frame;

a horizontal member mounted to the upper ends of the vertical members; and a lifting eye mounted to the horizontal member.

5. A lifting apparatus comprising:

a frame disposable on an article to be lifted and including at least two fulcrums distributed generally symmetrically around the frame;

at least two lifting arms each pivotally mounted to a corresponding fulcrum, each lifting arm having a lower end extending lower than the fulcrum and an upper end extending above the fulcrum, wherein the at least two lifting arms each include an approximately vertical portion outside of the frame mounted to an approximately horizontal portion extending outward from the exertion member to the upper end of the respective vertical portions;

a central exertion member including a top surface having one sloped portion for each lifting arm, the top surface of each sloped portion being downwardly inclined from the center of the exertion member and below the upper ends of the respective lifting arms to apply force to the upper ends of the lifting arms upon application of upward force to the exertion member; and vertical posts mounted to and on top of the exertion member, one vertical post mounted to each sloped portion of the exertion member, wherein the horizontal portions of the at least two lifting arms each include a vertical slot therethrough, and wherein each vertical post extends through and is slidably disposed in a corresponding vertical slot in the horizontal portion of each lifting arm.

6. The lifting apparatus of claim 5, further comprising load bearing means mounted to the vertical posts and adapted to receive lifting means.

7. The lifting apparatus of claim 6, wherein the load bearing means comprises a lifting eye mounted to horizontal parts that are mounted to the upper ends of the at least two vertical posts.

8. The lifting apparatus of claim 5, further comprising grippers mounted to the lower end of each lifting arm and each including a gripping surface proximate to the article.

9. The lifting apparatus of claim 8, wherein there are at least three lifting arms, at least three vertical posts, and at least three grippers.

10. A lifting apparatus comprising:

a frame disposable on an article to be lifted and including at least two fulcrums distributed generally symmetrically around the frame, wherein the frame includes:

a substantially planar and horizontally oriented base including an outside edge proximate to the article's outside edge;

vertical uprights including a lower end mounted to and distributed in spaced relation about the base; and a ring in a horizontal plane mounted to the upper end of the uprights and connecting adjacent uprights;

at least two lifting arms each pivotally mounted to a corresponding fulcrum, each lifting arm having a lower end extending lower than the fulcrum and an upper end extending above the fulcrum; and a central exertion member including a top surface having one sloped portion for each lifting arm, the top surface of each sloped portion being downwardly inclined from the center of the exertion member and below the upper ends of the respective lifting arms to apply force to the upper ends of the lifting arms upon application of upward force to the exertion member.

11. The lifting apparatus of claim 10, wherein the outside edge of the base is circular in the horizontal plane.

12. The lifting apparatus of claim 10, wherein the base comprises connected linear members.

13. The lifting apparatus of claim 10, wherein the outside edge of the ring is circular in the horizontal plane.

14. The lifting apparatus of claim 10, wherein the ring comprises connected linear members.

15. The lifting apparatus of claim 1, further comprising guide members mounted to the frame for aligning the frame on the article.

16. A lifting apparatus comprising:

a frame disposable on a cylinder to be lifted having a generally central and substantially vertical axis, the frame including:

a substantially planar and horizontally oriented base having an outside edge proximate to the cylinder's outside edge;

vertical uprights including a lower end mounted to and distributed in spaced relation about the base;

at least two fulcrums distributed generally symmetrically around the frame and extending outward with respect to the central axis; and a ring in a horizontal plane mounted to the upper end of the uprights and connecting adjacent uprights;

first load bearing means mounted to the frame and adapted to receive lifting means;

a lifting assembly comprising:

at least two lifting arms, distributed around the frame and each including an approximately vertical portion outside of the frame and being pivotally mounted to a corresponding fulcrum, each with a lower end that extends lower than the base, and each with an approximately horizontal portion extending radially from a central end proximate to the axis and above the ring and mounted to the upper end of the respective vertical portions, the horizontal portion having a vertical slot therethrough;

grippers mounted to the vertical portion of the lifting arms below the base, including a gripping surface proximate to the cylinder, and having a retracted position with the gripping surface not in contact with the cylinder and an engaged position with the gripping surface in contact with the cylinder;

a central exertion member including a top surface including one sloped portion for each lifting arm, with the top surface of each sloped portion downwardly inclined from the central axis and proximate to the bottom of each lifting arm horizontal portion proximate to the central axis; and vertical posts for lifting the lifting assembly mounted to the top of the exertion member, with one vertical post mounted to each sloped portion of the exertion member and extending through and slidably disposed in a corresponding slot in the horizontal portion of each lifting arm; and second load bearing means mounted to the vertical posts and adapted to receive lifting means, wherein when upward force is applied to the first load bearing means, the grippers are in retracted position, and wherein when upward force is applied to the second load bearing means, the sloped top surfaces of the exertion member apply force to the lifting arms to cause the horizontal portion central end of each lifting arm to move upward and radially outward, causing the upper end of each vertical portion to move outward, rotating each vertical portion around the fulcrum and actuating the grippers to be in the engaged position.

17. The lifting apparatus of claim 16, wherein the outside edge of the base is circular in the horizontal plane.

18. The lifting apparatus of claim 16, wherein the base comprises connected linear members.

19. The lifting apparatus of claim 16, wherein the outside edge of the ring is circular in the horizontal plane.

20. The lifting apparatus of claim 16, wherein the ring comprises connected linear members.

21. The lifting apparatus of claim 16, wherein the first load bearing means comprises:

at least two vertical members mounted to the frame at their lower ends and on opposite sides of the frame;

a horizontal member mounted to the upper ends of the vertical members; and a lifting eye mounted to the horizontal member.

22. The lifting apparatus of claim 16, wherein the second load bearing means comprises a lifting eye mounted to horizontal parts that are mounted to the upper ends of at least two vertical posts.

23. The lifting apparatus of claim 16, further comprising guide members mounted to the frame for aligning the frame on the cylinder.

24. The lifting apparatus of claim 16, wherein there are at least three lifting arms, at least three vertical posts, and at least three grippers.

25. A method of making a lifting apparatus comprising:

assembling a frame disposable on an article to be lifted and including parts including at least two fulcrums distributed generally symmetrically around the frame, wherein the parts are substantially fixed relative to each other;

mounting first load bearing means to the frame;

pivotally mounting a lifting arm to each fulcrum, each lifting arm having a lower end extending lower than the fulcrum and an upper end extending above the fulcrum, wherein the lower end of each lifting arm is adapted not to contact the article in a retracted position and to contact the article in an engaged position;

providing a central exertion member including a top surface having one sloped portion for each lifting arm, the top surface of each sloped portion being downwardly inclined from the center of the exertion member and below the upper ends of the respective lifting arms to apply force to the upper ends of the lifting arms upon application of upward force to the exertion member to rotate each lifting arm around the corresponding fulcrum from the retracted position to the engaged position, wherein in the absence of the application of external force to the exertion member the lifting arms are in the retracted position; and mounting second load bearing means to the exertion member.

26. A method of making a lifting apparatus comprising:

assembling a frame disposable on an article to be lifted and including at least two fulcrums distributed generally symmetrically around the frame;

pivotally mounting a lifting arm to each fulcrum, each lifting arm having a lower end extending lower than the fulcrum and an upper end extending above the fulcrum, wherein the lower end of each lifting arm is adapted not to contact the article in a retracted position and to contact the article in an engaged position and each lifting arm has an approximately vertical portion outside of the frame and an approximately horizontal portion extending outward from the exertion member and mounted to the upper end of the respective vertical portions, the horizontal portion having a vertical slot therethrough;

providing a central exertion member including a top surface having one sloped portion for each lifting arm, the top surface of each sloped portion being downwardly inclined from the center of the exertion member and below the upper ends of the respective lifting arms to apply force to the upper ends of the lifting arms upon application of upward force to the exertion member to rotate each lifting arm around the corresponding fulcrum from the retracted position to the engaged position;

extending a vertical post though each vertical slot in the horizontal portions of the lifting arms;

mounting the vertical posts to the exertion member top surface;

mounting first load bearing means to the vertical posts; and mounting second load bearing means to the frame.

27. A method of lifting an article comprising:

providing a lifting apparatus disposable on an article to be lifted, the: lifting apparatus including:

a frame including at least two fulcrums distributed generally symmetrically around the frame;

first load bearing means mounted to the frame;

at least two lifting arms each pivotally mounted to a corresponding fulcrum, each lifting arm having a lower end extending lower than the fulcrum and an upper end extending above the fulcrum, wherein the lower end of each lifting arm is adapted not to contact the article in a retracted position and to contact the article in an engaged position;

a central exertion member including a top surface including one sloped portion for each lifting arm, the top surface of each sloped portion being downwardly inclined from the center of the exertion member and below the upper ends of the respective lifting arms to apply force to the upper ends of the lifting arms upon application of upward force to the exertion member; and second load bearing means mounted to the exertion member;

applying upward force to the first load bearing means to lift the lifting apparatus;

placing the lifting apparatus into position on the article;

releasing the first load bearing means;

applying upward force to the second load bearing means to cause the exertion member to apply force to the upper ends of the lifting arms to cause each lifting arm to rotate around the corresponding fulcrum from the retracted position to the engaged position; and applying increased upward force to the second load bearing means to lift the lifting apparatus and the article.

28. A lifting apparatus comprising:

a frame disposable on an article to be lifted and including parts including a lower ring disposable on the article with at least two fulcrums distributed generally symmetrically around and mounted to the lower ring, an upper ring spaced from the lower ring and generally in a plane parallel to the plane in which the lower ring is oriented, and vertical members each having a lower end mounted to the lower ring and an upper end mounted to the upper ring, wherein the parts are substantially fixed relative to each other;

at least two lifting arms each pivotally mounted to a corresponding fulcrum, each lifting arm having a lower end extending lower than the fulcrum and an upper end extending above the fulcrum; and a central exertion member including a top surface having one sloped portion for each lifting arm, the top surface of each sloped portion being downwardly inclined from the center of the exertion member and below the upper ends of the respective lifting arms to apply force to the upper ends of the lifting arms upon application of upward force to the exertion member.

29. The lifting apparatus of claim 28, wherein the lower end of each lifting arm is adapted not to contact the article in a retracted position and to contact the article in an engaged position, wherein in the absence of the application of external force to the exertion member the lifting arms are in the retracted position, and wherein upon application of upward force to the exertion member the lifting arms rotate around the corresponding fulcrum from the retracted position to the engaged position.

30. The lifting apparatus of claim 28, wherein the exertion member engages the upper ends of the lifting arms in a manner selected from the group consisting of sliding engagement and rolling engagement.

31. The lifting apparatus of claim 28, wherein the at least two lifting arms each comprise an approximately vertical portion outside of the frame mounted to an approximately horizontal portion extending outward from the exertion member to the upper end of the respective vertical portions, the lifting arms have various positions, and the approximately vertical portion remains approximately vertical and the approximately horizontal portion remains approximately horizontal throughout the various positions.

32. The lifting apparatus of claim 28, further comprising load bearing means mounted to the frame and adapted to receive lifting means.

33. A lifting apparatus comprising:

a frame disposable on an article to be lifted and including at least two fulcrums distributed generally symmetrically around the frame;

at least two lifting arms each pivotally mounted to a corresponding fulcrum, each lifting arm having a lower end extending lower than the fulcrum and an upper end extending above the fulcrum;

a central exertion member including a top surface having one sloped portion for each lifting arm, the top surface of each sloped portion being downwardly inclined from the center of the exertion member and below the upper ends of the respective lifting arms to apply force to the upper ends of the lifting arms upon application of upward force to the exertion member; and load bearing means mounted to the frame and adapted to receive lifting means, wherein the first load bearing means comprises:

at least two vertical members mounted to the frame at their lower ends and on opposite sides of the frame; and a horizontal member mounted to the upper ends of the vertical members.

* * * * *